US006959459B2

(12) United States Patent
Takenaga

(10) Patent No.: US 6,959,459 B2
(45) Date of Patent: Nov. 1, 2005

(54) BODY WASHING UNIT FOR TOILET STOOL

(76) Inventor: Isao Takenaga, 67 Starr Ave., Turlock, CA (US) 95380

( * ) Notice: Subject to any disclaimer, the term of this patent is extended or adjusted under 35 U.S.C. 154(b) by 0 days.

(21) Appl. No.: 11/025,026

(22) Filed: Dec. 29, 2004

(65) Prior Publication Data

US 2005/0108816 A1 May 26, 2005

Related U.S. Application Data

(63) Continuation-in-part of application No. 10/754,976, filed on Jan. 9, 2004.

(51) Int. Cl.[7] ..... A47K 3/20
(52) U.S. Cl. ..... 4/420.4; 4/444; 4/447
(58) Field of Search ..... 4/420, 420.1–420.5, 4/443, 444, 447, 448

(56) References Cited

U.S. PATENT DOCUMENTS 4,028,745 A * 6/1977 Caniglia ..... 4/420.2
4,094,018 A * 6/1978 Bemthin ..... 4/420.4
4,553,274 A * 11/1985 Yui ..... 4/420.4
5,384,919 A * 1/1995 Smith ..... 4/448
5,839,129 A * 11/1998 Lee ..... 4/448
6,769,140 B1 * 8/2004 Olivier ..... 4/420.4

* cited by examiner

*Primary Examiner*—Justine R. Yu
*Assistant Examiner*—Huyen Le
(74) *Attorney, Agent, or Firm*—Gerald E. Hespos; Anthony J. Casella

(57) ABSTRACT

A body washing unit for a toilet has a first tube (211) for drawing warm water. A second substantially vertical tube (212) is connected rotatably with the first tube (211). A third tube (213) is connected rotatably with the end of the second tube (212) and a nozzle (214) is on the end of the third tube (213) for ejecting cleansing water. A drive rotates the second tube (212) around its axis (A2) to displace the third tube (213) angularly around the axis (A2) of the second tube (212). A converter (MC) converts rotational motion of the second tube (212) into rotational motion of the third tube (213) so that the nozzle (214) moves between its downwardly oriented posture (DP) at a standby position (S.P.) and its upwardly oriented posture (UP) at a usage position (U.P.).

13 Claims, 18 Drawing Sheets

BODY WASHING UNIT FOR TOILET STOOL

This is a continuation-in-part (C.I.P.) application based on apparent U.S. patent application Ser. No. 10/754,976, which was filed on Jan. 9, 2004.

BACKGROUND OF THE INVENTION

1. Field of the Invention

This invention relates to a body washing unit for a toilet stool which can be easily attached to a toilet stool that has already been installed.

2. Description of the Related Art

Toilet stools having the body-washing function of automatically washing an anal part with warm water after evacuation have been coming into wide use.

A conventional toilet stool having a body-washing function is configured by incorporating a heater tank for heating cold water from the outside to make the water warm, and a warm-water nozzle for emitting a jet of the warm water from the heater tank onto an anal part to wash the part. In the heater tank, which an electric heater is incorporated into, plenty of warm water required for one washing operation is constantly heated and stored. If you make a switching operation after evacuation, that allows warm water to jet out of the warm-water nozzle, washing your anal part clean.

Another type of body washing unit is also available on the market, which is provided as an additional function of already-installed toilet stools. Such a body washing unit is configured by incorporating a heater tank and a warm-water nozzle into a unit main body with a toilet seat and a toilet-seat cover as well.

In the above described prior art, the heater tank constantly warms up a proper quantity of warm water to a suitable temperature and holds it in storage. This could cause a considerable amount of electricity to waste. In addition, if the heater tank is installed at a place where warm water or boiling water can be used, some of installation expenses could go to waste. Furthermore, if an additional function-type of body washing unit is used, a reusable toilet seat or toilet-seat cover of a toilet stool that has already been installed has to be scrapped. This is because such a washing unit includes a toilet seat or a toilet-seat cover as its appendix.

In consideration of the aforementioned problems of the prior art, it is an object of the present invention to provide a body washing unit for a toilet stool where a warm-water nozzle is incorporated into a case body, which can be added to a toilet stool that has already been installed, with ease and within reason.

In addition, an idea of discharging cold water from a duct before the warm water is ready to be sprayed through a warm water nozzle was proposed and explained in detail in this Parent U.S. application Ser. No. 10/754,976. There is, however, still room for a further improvement in terms of structure regarding the discharging cold water before the warm water is ready to be sprayed from the nozzle.

SUMMARY OF THE INVENTION

In order to attain the above object, according to this invention, a body washing unit for a toilet stool, comprising: a first tube 211 for drawing a warm water from a warm water source; a second tube 212 being rotatably connected with the first tube 211, the second tube 212 being oriented substantially in a vertical direction; a third tube 213 being rotatably connected with the lower end of the second tube 212; a nozzle 214 fixedly provided on the leading end of the third tube 213 for ejecting a warm water to cleanse a certain portion of a body; a drive means for rotating the second tube 212 around its own axis (A2) such that the third tube 213 is angularly displaced around the central axis (A2) of the second tube 212 between a standby position (S.P.) and a usage position (U.P.) via a motion conversion means (MC); said motion conversion means (MC) converting the rotational motion of the second tube 212 around its own axis (A2) into the rotational motion of the third tube 213 around its central axis (A3) such that the nozzle 214 changes its orientation between its downwardly oriented posture (DP) at the standby position (S.P.) and its upwardly oriented posture (UP) at the usage position (U.P.); and a timing controller for controlling a timing of the operation of the nozzle 214 such that cold water remaining in the first tube 211 is discharged before the ejection of the warm water from the nozzle 214.

These and other objects, features and advantages of the invention will become more apparent upon reading the following detailed description along with the accompanying drawings.

DETAILED DESCRIPTION OF THE PREFERRED EMBODIMENTS

Hereinafter, a body washing unit for a toilet stool according to an embodiment of the present invention will be described with reference to the attached drawings.

Figure 1:
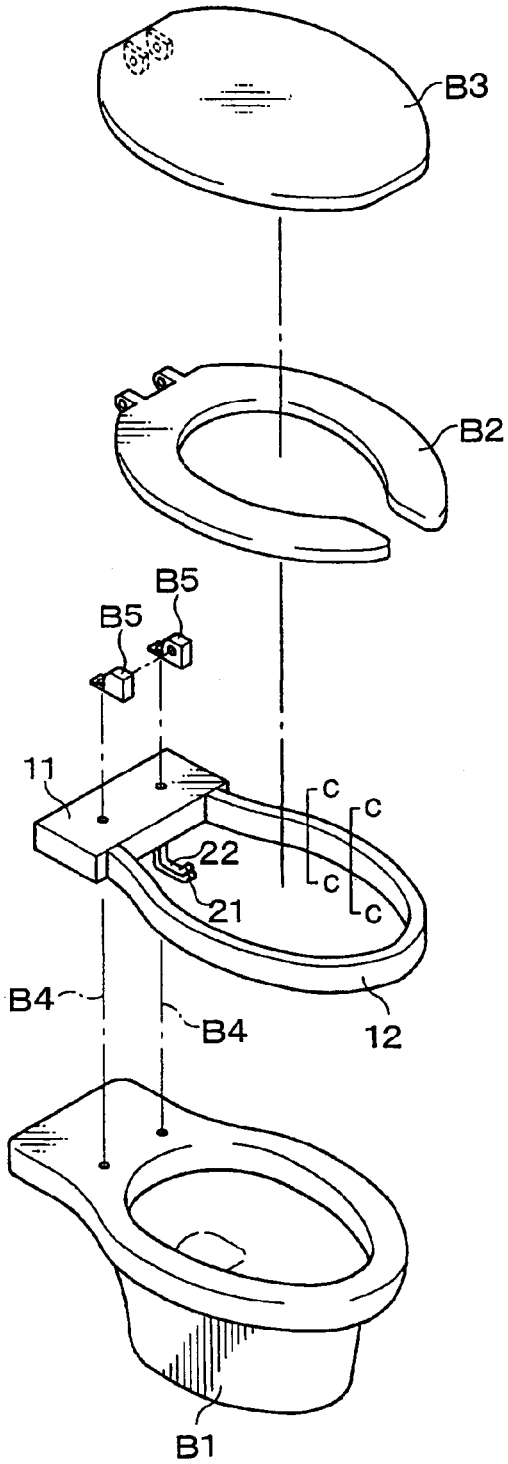
FIG. 1 is a perspective exploded view showing how to use a body washing unit for a toilet stool according to the present invention.

The body washing unit for a toilet stool comprises a case body 11 and a warm-water nozzle 21 incorporated into the case body 11 (see FIG. 1).

The case body 11 can be disposed on the upper-surface rear part of a toilet-stool main body B1 of an already-installed toilet stool by means of bolts B4, B4 for attaching a toilet seat B2 and a toilet-seat cover B3. Herein, the bolts B4, B4 are bolts for fixing hinge bodies B5, B5 by means of which the toilet seat B2 and the toilet-seat cover B3 are attached to a toilet-stool main body B1. The toilet seat B2 and the toilet-seat cover B3 can be hinged and connected to the upper surface of the case body 11 on the toilet-stool main body B1, using the hinge bodies B5, B5. A spacer frame 12 supporting the toilet seat B2 on the toilet-stool main body B1 is attached to the front surface of the case body 11. Herein, the spacer frame 12 has a substantially same shape as the upper surface of the toilet-stool main body B1 so as to securely support the toilet seat B2 located on the case body 11 over the toilet-stool main body B1.

Figure 2:
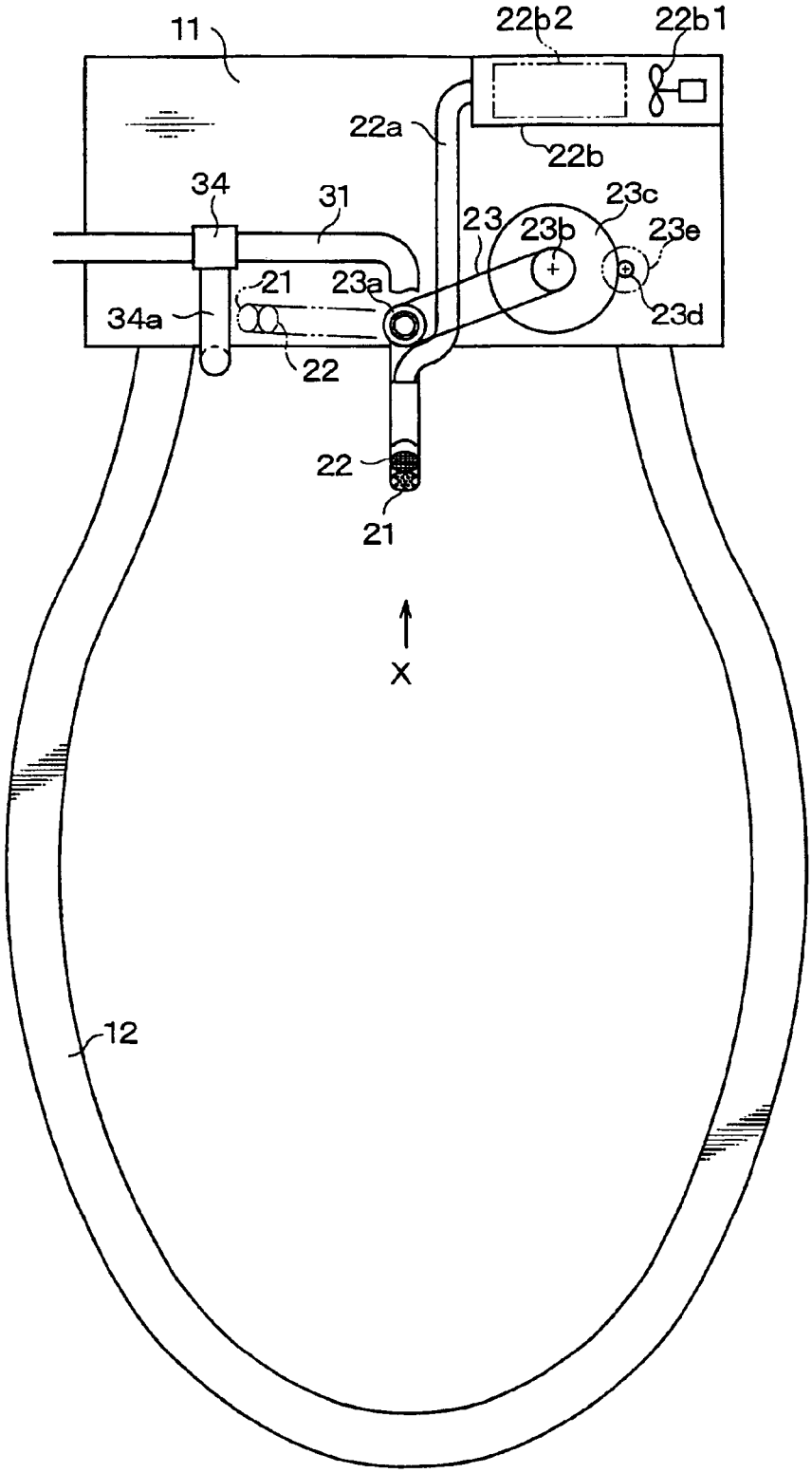
FIG. 2 is a top plan view showing the whole configuration of the body washing unit.
Figure 3:
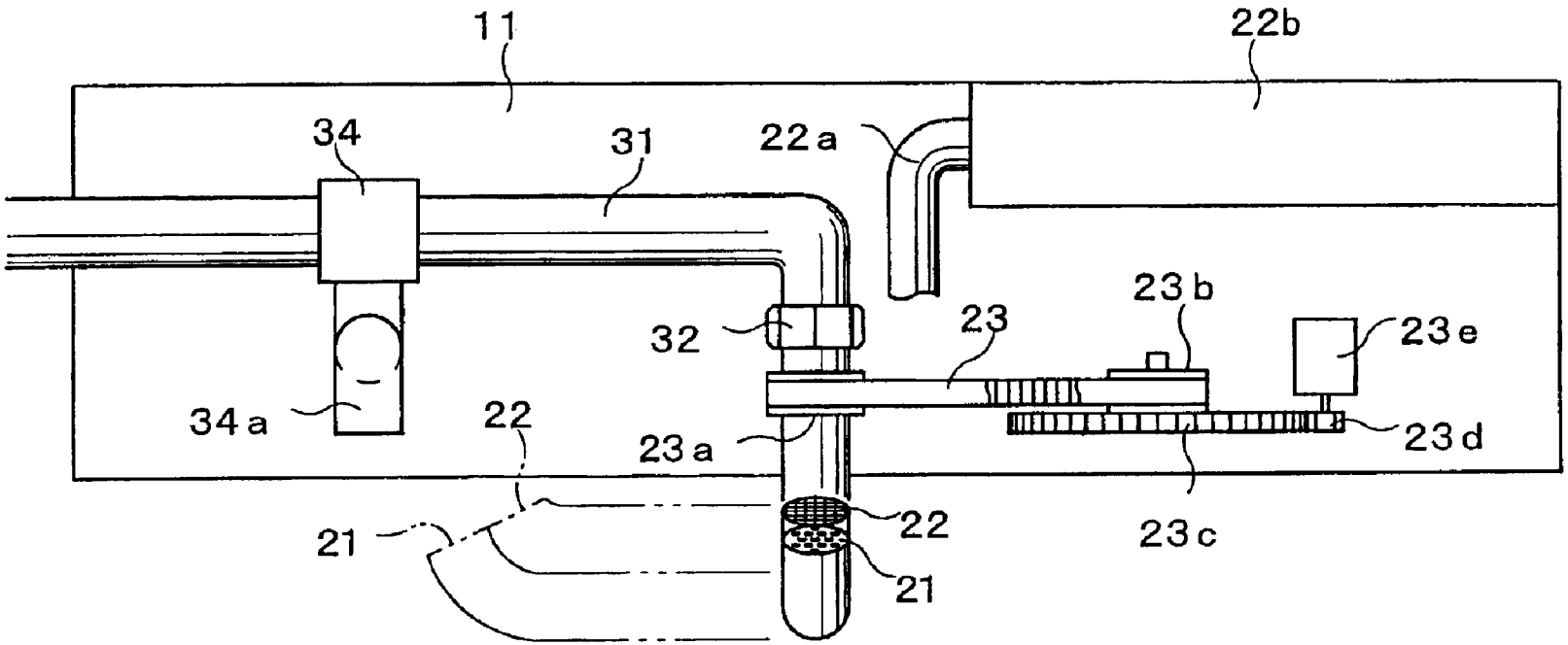
FIG. 3 is a plan view seen from the direction of an arrow X of FIG. 2.

The warm-water nozzle 21 is integrated with a warm-air nozzle 22 (see FIG. 2 and FIG. 3). On the side of the front surface of the case body 11, the warm-water nozzle 21 and the warm-air nozzle 22 extend downward, bend forward and obliquely bend up. Thereby, the warm-water nozzle 21 and the warm-air nozzle 22 emits a jet of warm water, and blows a blast of warm air, respectively, onto the anal part of a user sitting on the toilet seat B2.

The warm-water nozzle 21 is supported to a downward-bending part of a duct passage 31 for supplying warm water inside the case body 11, via a rotary joint 32, so that it can turn horizontally. A timing pulley 23*a* for a timing belt 23 is attached to a base part of the warm-water nozzle 21. The other timing pulley 23*b* for the timing belt 23 is connected to a motor 23*e* via gears 23*c*, 23*d*. The warm-water nozzle 21, together with the warm-air nozzle 22, can be electrically driven by the forward and reverse drive of the motor 23*e*. Specifically, they are driven between a usage position (see each solid line of FIG. 2 and FIG. 3, and FIG. 1) on the side of the front surface of the case body 11 and a waiting position (see each two-dotted chain line of FIG. 2 and FIG. 3) inside the case body 11.

The warm-air nozzle 22 is connected to a warm-air heater 22*b* inside the case body 11 via a flexible hose 22*a* having a sufficient length. The warm-air heater 22*b* is configured, for example, by disposing an electric heater 22*b*2 ahead of a motor-driven fan 22*b*1 (see FIG. 2), so that warm air can be blown out of the tip of the warm-air nozzle 22 through the flexible hose 22*a*.

Figure 4:
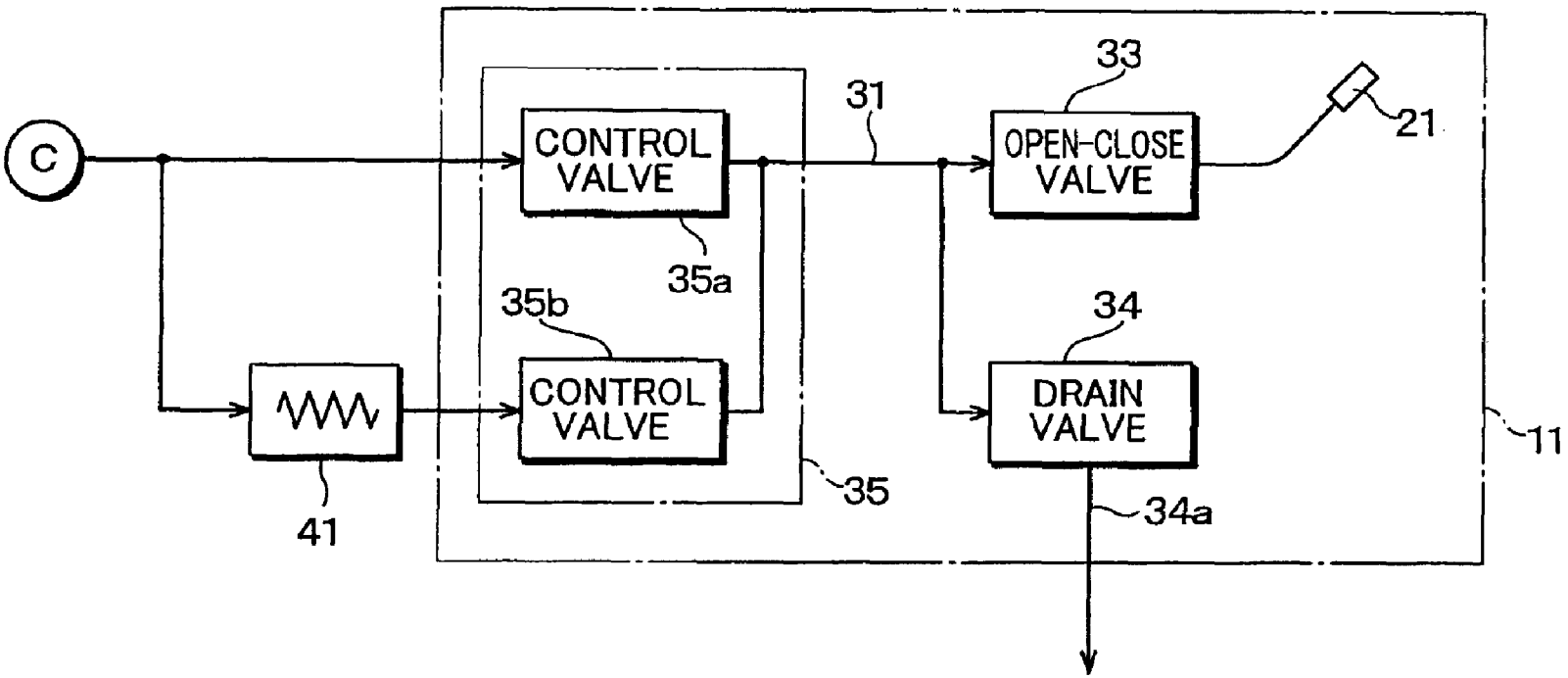
FIG. 4 is a water-flow diagram of the body washing unit.

An open-close valve 33, a drain valve 34 and a mixing valve 35, which are incorporated into the case body 11, are connected to the duct passage 31 for the warm-water nozzle 21 (see FIG. 4). The duct passage 31 branches off to the drain valve 34 at an upstream place of the open-close valve 33. The outlet of the drain valve 34 is open via a drain duct 34*a* over the toilet-stool main body B1 (see FIG. 2 and FIG. 3). Herein, FIG. 2 and FIG. 3 show only the drain valve 34 and the drain duct 34*a* as typical members.

Figure 5:
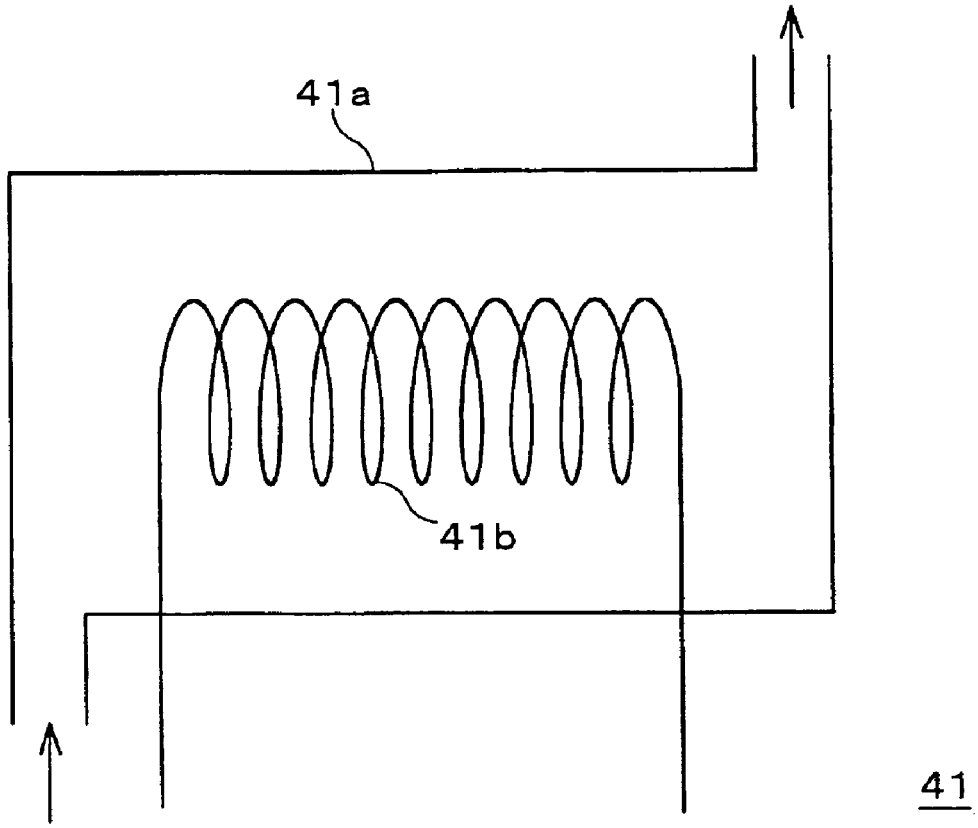
FIG. 5 is a schematic illustration showing a typical configuration of a major of a heater unit.

The mixing valve 35 is configured by combining control valves 35*a*, 35*b* on each side of cold water and hot water, respectively (see FIG. 4). The inlet of the control valve 35*a* on the cold-water side is connected to an outside water source C, while the inlet of the control valve 35*b* on the hot-water side is connected to a forked steam of the water source C, via a heater unit 41 attached to the outside of the case body 11. Herein, the heater unit 41 is configured, for example, by housing a sheathed heater 41*b* in a case-shaped heat-exchanger unit 41*a* (see FIG. 5), so that it works as an electric heater of the instantaneous water heater-type which heats up cold water flowing inside the heat-exchanger unit 41*a* to a suitable temperature. Herein, power switching of the sheathed heater 41*b* is properly controlled, for example, based on water temperatures on the outlet side of the heat-exchanger unit 41*a*.

Figure 6:
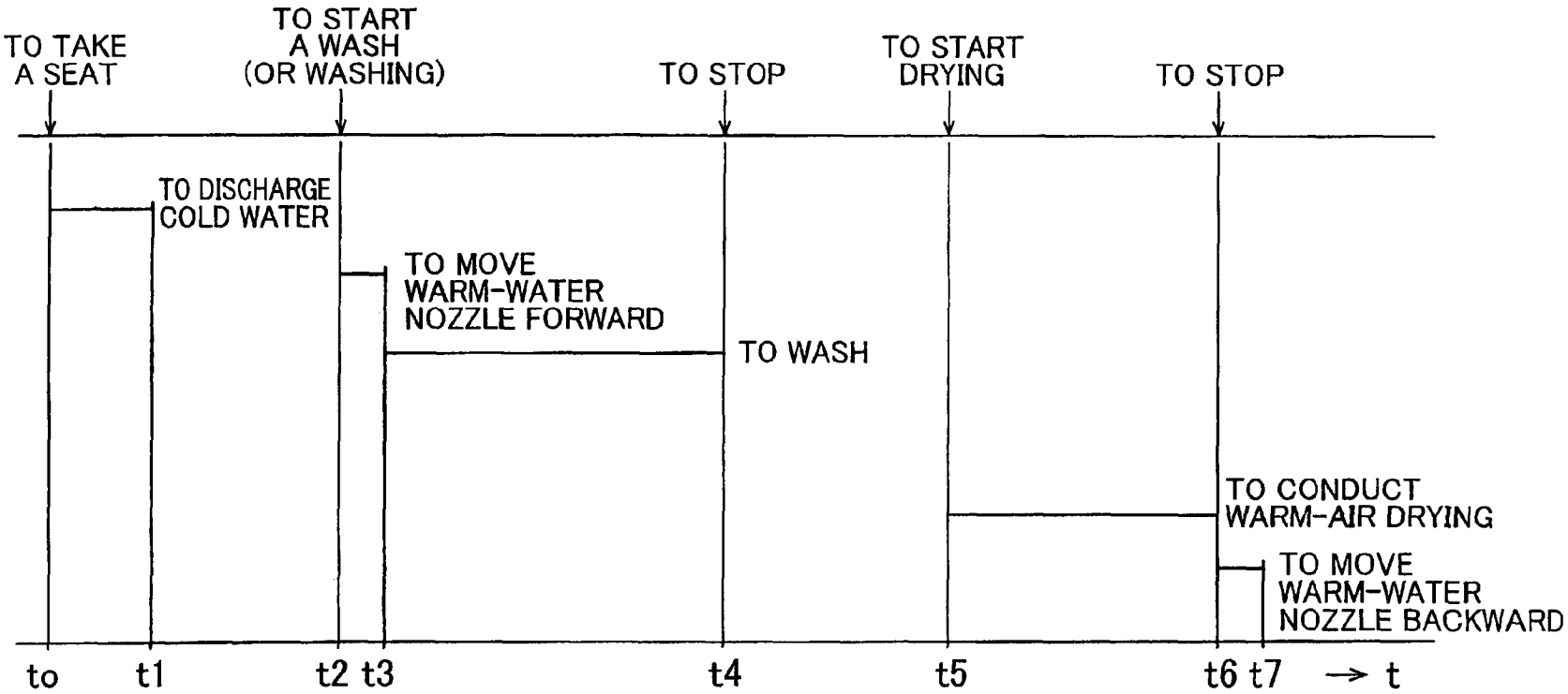
FIG. 6 is a graphical representation showing an operation of the body washing unit.

The body washing unit for a toilet stool, for example, works as shown in FIG. 6. In the body washing unit before use (at Time $t.t_0$ in FIG. 6), the warm-water nozzle 21 and the warm-air nozzle 22 is kept back at a waiting position inside the case body 11. The control valves 35*a*, 35*b* of the mixing valve 35, the open-close valve 33 and the drain valve 34 are all kept fully closed. And the heater unit 41 is not at work. When a user sits on the toilet seat B2 (at Time $t=t_0$ in FIG. 6, hereinafter simply referred to as ($t=t_0$)), a sensor (not shown) works to operate the heater unit 41 and open the control valves 35*a*, 35*b* of the mixing valve 35 to proper widths. Then, the drain valve 34 opens, discharging the cold water inside the duct passage 31 for the warm-water nozzle 21 into the toilet-stool main body B1 ($t=t_0$ to $t_1$). The mixing valve 35, via the control valves 35*a*, 35*b*, mixes cold water from the water source C and hot water from the heater unit 41 into warm water having a suitable temperature. Herein, the control valves 35*a*, 35*b* open automatically to predetermined widths so that warm water with a suitable temperature can be jetted out of the warm-water nozzle 21 with a proper water-current force. The cold water inside the duct passage 31 on the upstream side of the open-close valve 33 is all discharged and replaced with warm water from the mixing valve 35. Then the drain valve 34 is closed to start a waiting time ($t.t_1$).

When the user operates a switch (not shown) to give the command to start a wash after evacuation ($t=t_2$), the motor 23*e* works to advance the warm-water nozzle 21 and the warm-air nozzle 22 to a usage position ($t=t_2$ to $t_3$). Then, the open-close valve 33 opens ($t=t_3$) and the warm water jetted out of the warm-water nozzle 21 can wash the user's anal part ($t=t_3$ to $t_4$). Next, when the user operates a switch (not shown) to give the command to stop ($t=t_4$), the open-close valve 33 closes to complete the washing operation.

Next, when the user operates a switch (not shown) to give the command to start a drying operation ($t=t_5$), the warm-air heater 22*b* works so that the user can dry the anal part after the wash, using a blast of warm air from the warm-air nozzle 22 ($t=t_5$ to $t_6$). When the user gives the command to stop ($t=t_6$), the warm-air heater 22*b* stops and then the warm-water nozzle 21 and the warm-air nozzle 22 are moved back to the initial waiting position by means of the motor 23*e* ($t=t_6$ to $t_7$), allowing such a series of operations to be completed.

Figure 7:
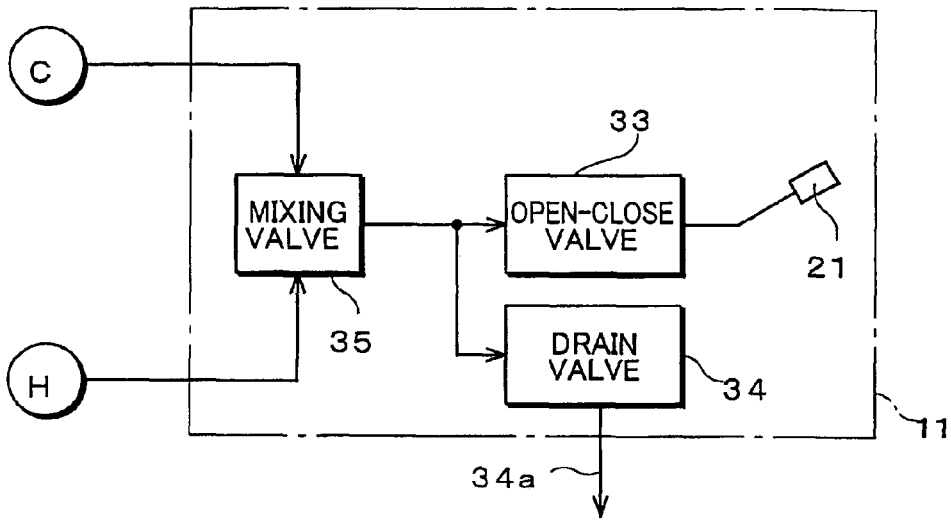
FIG. 7 is a water-flow diagram of a body washing unit for a toilet stool according to another embodiment, equivalent to FIG. 4.

At a location where a hot-water source H supplying warm water or hot water can be used, the heater unit 41 is not needed, and instead, the inlet on the hot-water side of the mixing valve 35 may be directly connected to the hot-water source H (see FIG. 7). In FIG. 4 and FIG. 7, the open-close valve 33 and the drain valve 34 may also be replaced with a single three-way selector valve which opens on either side of the warm-water nozzle 21 or the drain duct 34*a*, or closes on both sides.

Figure 8:
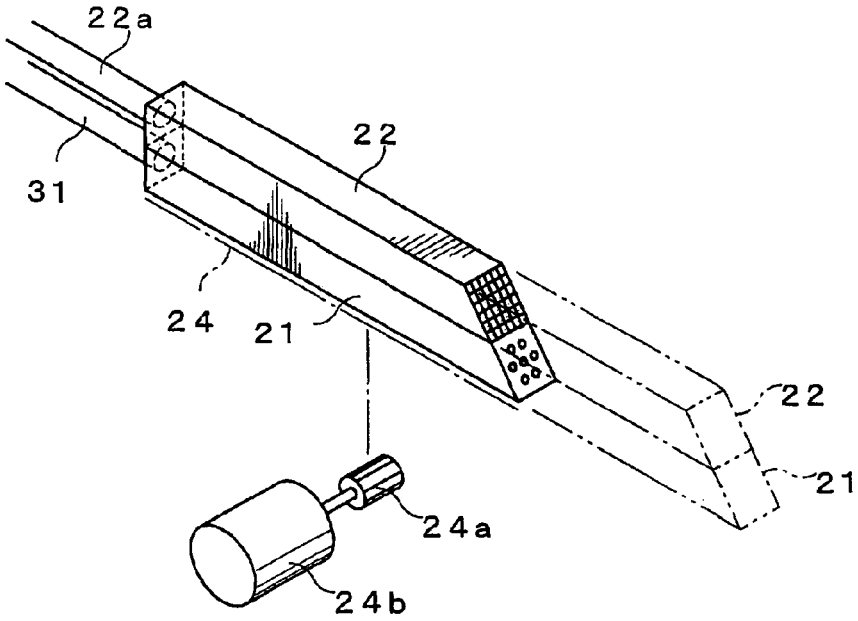
FIG. 8 is a perspective exploded view (1) showing a major part of a body washing unit for a toilet stool according to another embodiment.

The timing belt 23 used for the warm-water nozzle 21 and the warm-air nozzle 22 may also be replaced with: a rack 24 which unites the warm-water nozzle 21 and the warm-air nozzle 22; and a pinion 24*a* revolved by a motor 24*b*. According to this configuration, the warm-water nozzle 21 and the warm-air nozzle 22 are driven straight between a waiting position (see the solid line of FIG. 8) and a usage position (see the two-dotted chain line of FIG. 8). Herein, the tip part of the duct passage 31 connected to the warm-water nozzle 21 is formed out of a flexible hose, enabling the warm-water nozzle 21 to make motions.

Furthermore, the motors 23*e*, 24*b* used for electrically driving the warm-water nozzle 21 and the warm-air nozzle 22 may also be replaced, for example, with a hand-powered driving system for rotating the timing pulley 23*b* and the pinion 24*a* by means of a manual handle on the outside. Furthermore, the warm-water nozzle 21 and the warm-air nozzle 22 may also be separately driven to a waiting position and a usage position. For example, only the warm-water nozzle 21 may be driven to a waiting position and a usage position, while the warm-air nozzle 22 may be disposed and fixed inside the case body 11. This is because there is no need to control the blowing direction of warm air from the warm-air nozzle 22 with a fair degree of precision, as long as the warm air can dry an anal part. Furthermore, the warm-water nozzle 21 may also be driven to a waiting position and a usage position, by expanding and contracting its tip part in a telescopic way.

Figure 9:
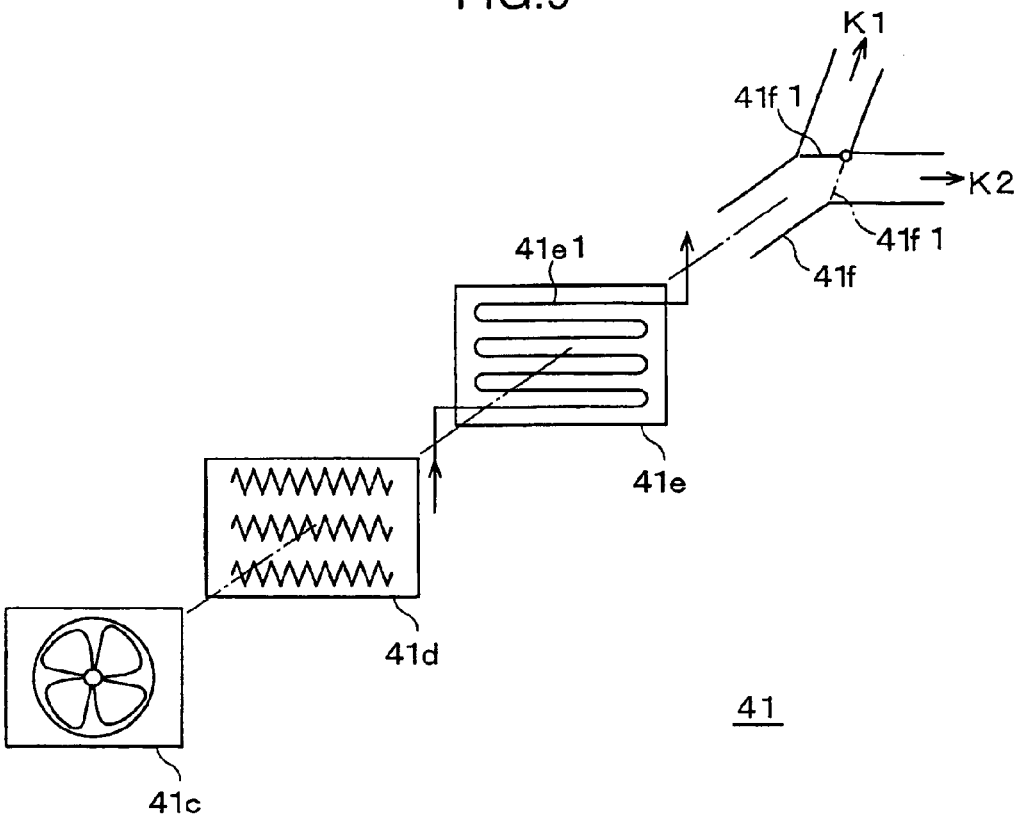
FIG. 9 is a perspective exploded view (2) showing a major part of a body washing unit for a toilet stool according to another embodiment.

The heater unit 41 can be configured by integrating a fan unit 41*c*, an electric heater 41*d* and a heat-exchanger unit 41*e* in the front-and-rear direction. A current of air blown by the fan unit 41*c* passes through the electric heater 41*d* and becomes hot. When passing through the heat-exchanger unit 41*e*, the hot air indirectly heats up water flowing through a finny coiled pipe $\mathbf{41}e_1$ to make the water hot so that it can be supplied to the mixing valve 35. Herein, hot air from the heat-exchanger unit 41*e* can be emitted outdoors, or used for indoor heating, by means of a louver $\mathbf{41}f_1$ attached inside a forking duct 41*f* (see the solid line and the two-dotted chain line of FIG. 9). In other words, one of the outlets of the forking duct 41*f* is open on the outside of a toilet booth housing a toilet stool (in the $K_2$ direction of FIG. 9). Herein, it is enough, for example, just to switch the louver $\mathbf{41}f_1$ manually according to the season.

In the above explanation, the spacer frame 12 on the front-surface side of the case body 11 can be omitted, for example, by additionally attaching a suitable spacer block onto the lower-surface side of the toilet seat B2. Herein, a toilet seat and a toilet-seat cover (not shown) which have already been hinged and connected to the case body 11 can also be used, so that no already-installed toilet seat and toilet-seat cover would have to be reused.

According to the first-described embodiment, cold water inside the duct passage 31 is discharged by opening the drain valve 34. However, the cold water inside the duct passage 31 from the mixing valve 35 to the open-close valve 33 may also be discharged by the process of: opening both the open-close valve 33 and the drain valve 34 before opening the mixing valve 35 to discharge the cold water inside the duct passage 31 from the open-close valve 33 to the warm-water nozzle 21; thereafter, closing the open-close valve 33; and opening the mixing valve 35. Preferably, the duct passage 31 from the mixing valve 35 to the warm-water nozzle 21, and the warm-water nozzle 21 itself, should each have a shape and an inclination suitable for cold water inside them to be discharged through the drain valve 34 as completely as possible. Instead of an electrically-operated valve, the mixing valve 35, the open-close valve 33 and the drain valve 34, may also be a hand-powered valve which a user sitting on the toilet seat B2 can operate manually on the outside of the case body 11.

Figure 10:
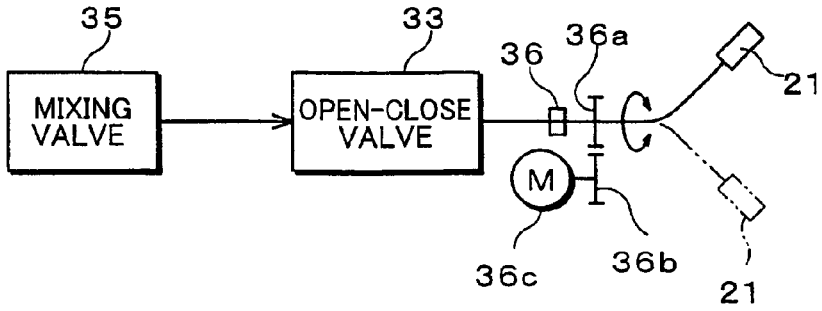
FIG. 10 is a schematic illustration showing the configuration of a major part of a body washing unit for a toilet stool according to another embodiment.

In FIG. 4 and FIG. 7, you can omit the drain valve 34 and the drain duct 34*a* by placing the warm-water nozzle 21 at a usage position and allowing it to switch from upward to downward (FIG. 10). A rotary joint 36 is attached to the base part of the warm-water nozzle 21. The bending duct passage from the rotary joint 36 to the warm-water nozzle 21 can be turned in forward and reverse directions (the arrow directions of FIG. 10) by a motor 36*c* connected thereto via gears 36*a*, 36*b*. The warm-water nozzle 21 is turned downward at a usage position (see the two-dotted chain line of FIG. 10) and the mixing valve 35 and the open-close valve 33 are opened. Thereby, the cold water inside the duct passage leading to the warm-water nozzle 21 can be discharged into the toilet-stool main body B1. Thereafter, if turned upward (see the solid line of FIG. 10), it can emit a jet of warm water to wash an anal part for its regular use. In FIG. 10, the warm-water nozzle 21 may also be turned, either together with the warm-air nozzle 22 or alone separately from the warm-air nozzle 22.

As described above, in the body washing unit for a toilet stool according to the present invention, a warm-water nozzle is incorporated into a case body, and cold water in a duct passage for the warm-water nozzle is discharged before the warm-water nozzle is used. This allows the user to feel comfortable when using the body washing unit, without any heater tank. Furthermore, the present invention simplifies the entire configuration of the body washing unit and enables an already-installed toilet seat and toilet-seat cover to be reused. As a result, the body washing unit can be added to a toilet stool that has already been installed, with ease and within reason.

A detailed construction enabling the aforementioned switching operation of the warm-water nozzle is hereinafter explained in detail with reference to FIGS. 11 to 18.

Figure 11:
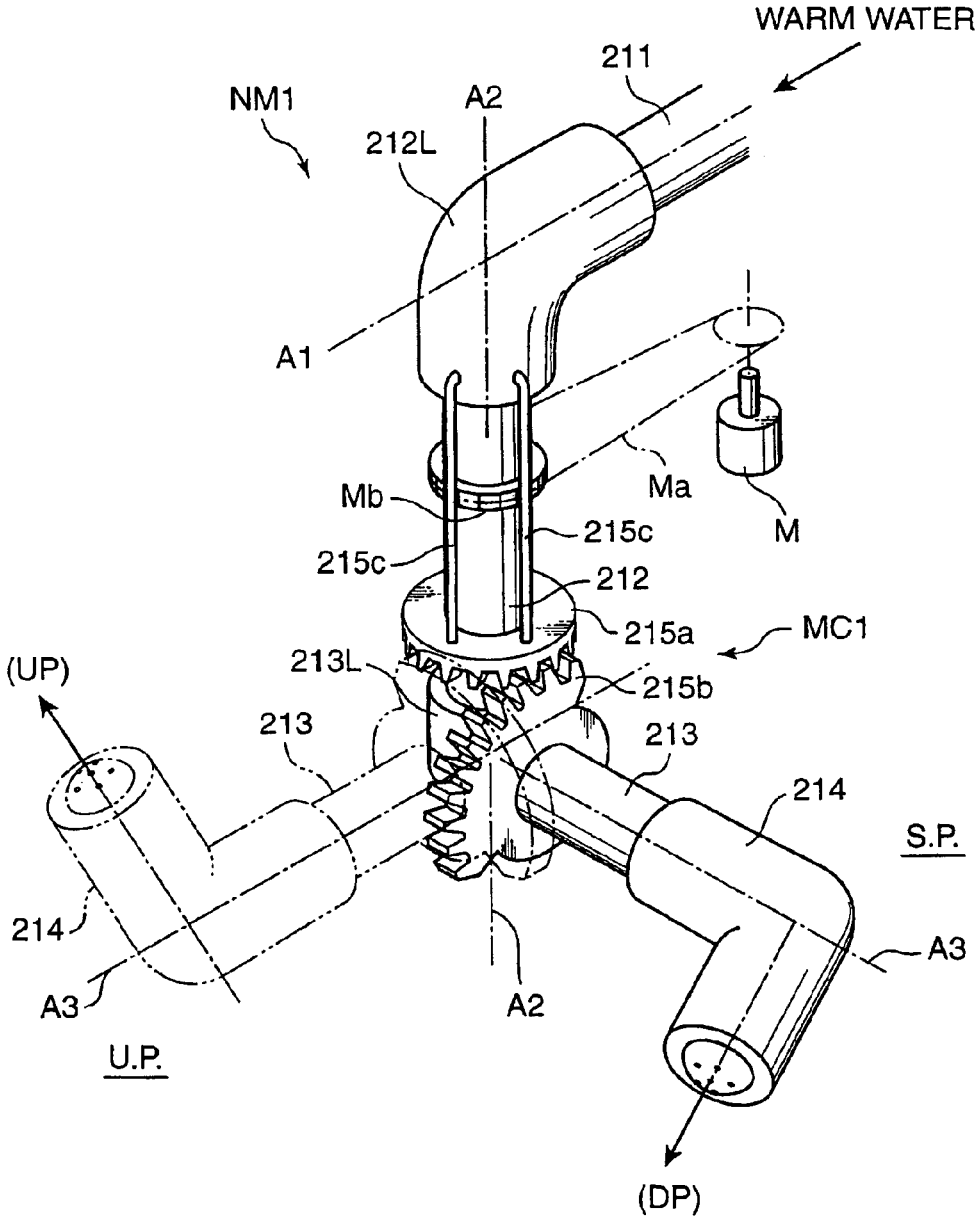
FIG. 11 is a perspective view showing a nozzle posture changing mechanism (as a $1^{st}$ embodiment)

There are shown two embodiments, for a nozzle posture changing mechanism (NM1 & NM2). First of all, all the common elements for the first and the second embodiments of the nozzle posture changing mechanism are explained as follows:

In both embodiments as shown in FIG. 11 (1st Embodiment: NM1) and FIGS. 12A–C (2nd Embodiment: NM2), a horizontal tube 211 (hereinafter simply referred to as "first tube 211") is to be fixedly provided at a proper position with respect to a toilet-stool main body B1 to draw warm water from the duct passage 31 (not shown in FIGS. 11 and 12: see FIG. 15). The first tube 211 is provided to the toilet-stool main body B1 in such a manner that it extends across the upper edge of the toilet-stool main body B1.

A vertical tube 212 (hereinafter referred to as "second tube 212" for simplicity) is provided such that it extends downwardly from the leading end of the first tube 211 to inner side of the toilet-stool main body (B1) and is rotatable around is own axis (A2). When the drive power is transmitted to a sprocket portion (Mb) fixedly provided around the second tube 212 from a motor M through a chain (Ma) (as a drive power transmission means), the second tube 212 is driven to rotate about its axis (A2). In addition, the motor M can be driven in either direction so that the second tube 212 is rotatable around its own axis (A2) in either counter-clockwise or clockwise direction. An L-shaped holder 212L allows a connection between the first tube 211 and the second tube 212 such that the first tube 211 is fixed onto the L-shaped joint 212L and the second tube 212 is rotatable with respect to the L-shaped joint 212L.

Note that the sprocket (Mb) placed around the second tube 212 can be replaced with a gear (as a driven member) and the chain (Ma) can be replaced with a timing belt (as a drive power transmission means). In addition, the chain or the timing belt can be omitted by providing a drive gear mounted on the motor shaft that is in direct mesh with the driven gear fixedly placed around the second tube 212. In this case, the drive gear of the motor (M) constitutes said drive transmission member for transmitting a drive power from the motor (M) to the driven member. Needless to say but when the drive gear of the motor (M) is in direct mesh with the driven gear of the second tube 212, the rotational direction of the motor needs to be revised.

A nozzle tube (hereinafter simply referred to as "third tube 213") horizontally extends from the lower portion of the second tube 212 and comprises a nozzle 214 on a lead end thereof.

The third tube 213 is horizontally extended and is swiveled around the longitudinal axis (A2) of the second tube 212 and it is rotatable around its own axis (A3) simultaneously with the swiveling motion around the axis (A2). In other words, the third tube 213 swivels (around the axis A2) and rotates (around the axis A3) with the rotation of the second tube 212, and this movement switches an orientation (posture) of the nozzle 214 between an oblique downward direction at standby position (S.P.) and to an oblique upward direction at usage position (U.P.), which will be explained in more detail in the later.

Furthermore, a motion conversion means (MC1) which changes the posture of the nozzle 214 with respect to the longitudinal axis (A3) of the third tube 213 between an upwardly directing posture and a downwardly directing posture. The motion conversion means (MC1) converts the rotational motion of the second tube 212 around its own axis (A2) into the rotational motion of the third tube 213 around its central axis (A3) such that the nozzle 214 changes its orientation between its downwardly oriented posture (DP) at the standby position (S.P.) and its upwardly oriented posture (UP) at the usage position (U.P.).

The first embodiment for the nozzle posture changing mechanism (NM1) (FIG. 11) will be in particularly explained in detail as follows.

When the second tube 212 is rotated 90 degrees around its own axis (A2) in either direction due to the drive power transmitted to the sprocket Mb from the motor M via the drive chain (Ma) (any other means for power transmission can be used such as a belt, a rubber band, etc), a posture of the nozzle 214 with respect to the longitudinal axis A3 of the third tube 213 changes between its downwardly directing posture (DP) and upwardly directing posture (UP) by a motion conversion means (MC1). Note that the rotational angle of the second tube 212 by the motor M is not limited to the aforementioned 90 degrees, this value is considered to be one of the feasible examples.

The motion conversion means (MC1) for this first embodiment includes a fixed member 215*a* having a first gear portion provided around the lower portion of the second tube 212 and a driven member 215*b* having a second gear portion in mesh with the first gear portion of the fixed member 215*a*, said fixed member 215*a* is fixedly provided with respect to the first tube 1 so that the second tube 212 is freely rotatable with respect to the fixed member 215*a* and said driven member 215*b* is fixedly provided around the third tube 213 so that when the second tube 212 is rotated around its own axis (A2) and the third tube 213 is swiveled about the center axis (A2), the driven member 215*b* in mesh with the fixed member 215*a* is driven by the first gear portion of the fixed member 215*a* so that the third tube 213 is rotated around its own axis (A3).

The fixed member 215*a* with rack teeth is fixedly provided to the L-shaped joint 212L by supporting rods 215*c* and 215*c*.

Since the second tube 212 and the third tube 213 only have a rotational range of about 90 degrees, needless to say this angle is one of feasible examples, it is not necessary to form shapes of the rack teeth 215*a* and the gears on the driven member 215*b* in a regular gear having a complete circular configuration. Instead, for the gears for both fixed member 215*a* and the driven member 215*b*, approximately one-third of the circle is sufficient.

Moreover, for the gears on both fixed member 215*a* and the driven member 215*b*, any one of proper kinds of teeth combination, such as a pair of meshing bevel gears, according to "Japanese Industrial Standard", that are deemed reasonable by those skilled in the art should be applicable as long as the 90 degree shifting power transmission can be made possible between the second and the third tubes 212, 213.

Figure 12A:
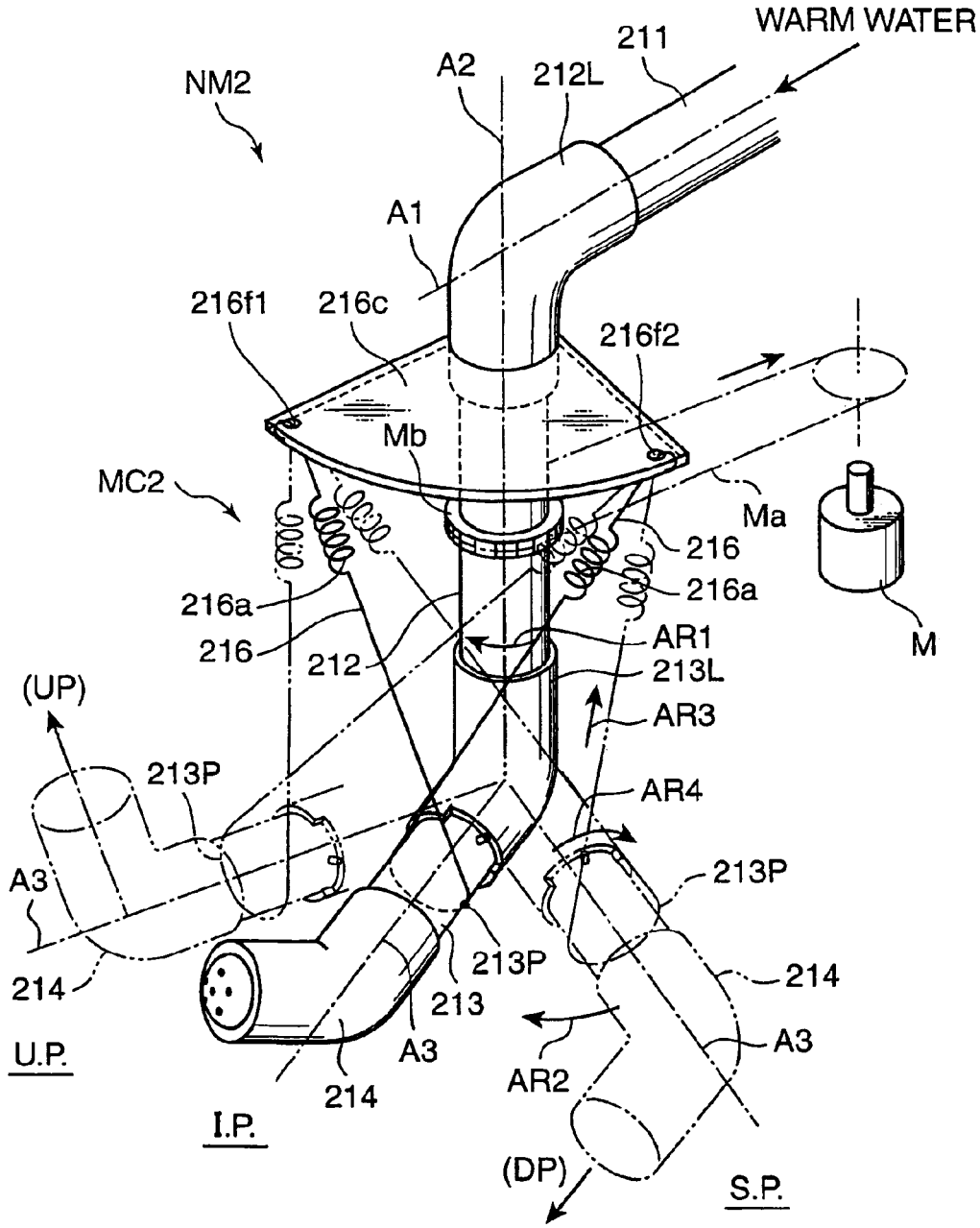
FIG. 12A is a perspective view showing another embodiment of the nozzle posture changing mechanism (as a $2^{nd}$ embodiment), where "S.P." stands for a standby position at which a nozzle is directing obliquely downward direction and "U.P." stands for a usage position at which a nozzle is directing obliquely upward direction.
Figure 12B:
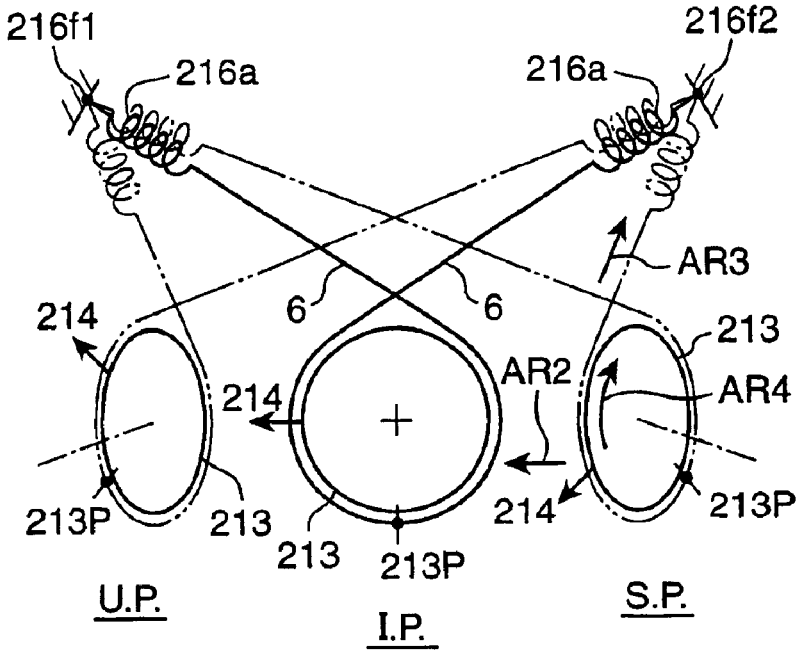
FIG. 12B is an explanatory view showing a movement of the motion conversion mechanism where "S.P." stands for a standby position, "IP" stands for an intermediate position, and "U.P." stands for a usage position.
Figure 12C:
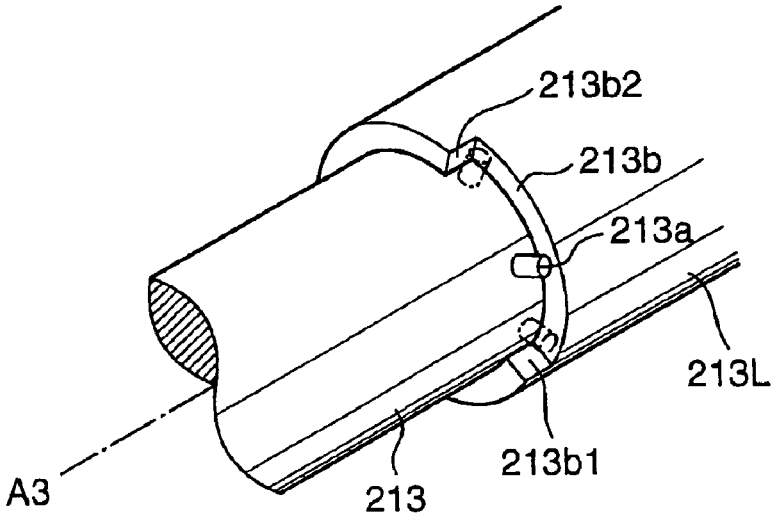
FIG. 12C is a perspective view showing a motion restricting member which restricts a rotational motion of the third tube about its own axis.

Next, the second embodiment for the nozzle posture changing mechanism (NM2: FIGS. 12A to 12C) will be explained in detail as follows.

The second embodiment is essentially the same as the first embodiment except the motion conversion means, thus this different element is explained in details as follows. The rest of the elements constituting the second embodiment of the nozzle posture changing mechanism (NM2) are assumed to be the same, or substantially the same, as the elements used in the first embodiment thus the detailed explanations of those common elements are omitted for the simplicity.

In this second embodiment, the motion conversion means (MC2) includes an engaging plate 216*c* having engaging portions 216*f*1, 216*f*2 provided around the upper part of the second tube 212 such that the second tube 212 is rotatable with respect to the engaging plate 216*c* and a drive member 216 being in a form of elastic string, having opposite ends fixed onto the engaging portions 216*f*1, 216*f*2 of the engaging plate 216*c* and a middle portion fixed onto a predetermined point 213*p* on the outer circumferential surface of the third tube 213. The string form drive member 216 is wound around the third tube 213 with said fixed point 213*p* and thus when the third tube 213 is being swiveled around the second axis (A2) due to the rotation of the second tube 212 around its own axis (A2), the third tube 213 is being rotated around its own axis (A3).

In order to rotate the third tube 213 around its own axis (A3) by the rotation of the second tube 212 around its own axis (A2), a string 216 with tension springs 216*a* is used. The string 216 is wound one time around the circumference of the third tube 213 as clearly shown in FIG. 12A or 12B and the opposite ends of the string 216 are fixed to the respective engaging points 216*f*1, 216*f*2 of the engaging plate 216*c* through the respective tension spring 6*a* and a middle point of the string 216 is fixed at the predetermined point 213P on an circumferential surface of the third tube 213 in such a manner that the tension force generated in the string 216 is transmitted to the outer circumference area of the third tube 213.

It can be easily seen with reference to FIG. 12A and FIG. 12B, when the second tube 212 is rotated around the axis (A2) in a clockwise direction (AR1) and the third tube 213 is horizontally swiveled around the axis (A2) in a clockwise direction (AR2), the string 216 is pulled toward one end 216*f*2 (see an arrow AR3), and the third tube 213, thus, is driven to rotate in a clockwise direction (AR4) and then an orientation of the nozzle 214 changes from an originally obliquely downwardly directing posture (DP) towards an upwardly directing posture. Similarly, if the second tube 212 is rotated around the axis (A2) in a counterclockwise direction, then the string pulling direction and the rotational direction of the third tube 213 and the nozzle posture changing direction will be merely reversed.

Further, the rotational range of the third tube 213 is restricted to 90 degrees by adapting a projection 213*a* to engage with both limit portions 213*b*1, 213*b*2 of a notched portion 213*b* (see FIG. 12C). Note that the restriction angle of 90 degrees is merely one of the feasible examples and is understood that the inventor has no intentions whatsoever to restrict the scope of this invention by provision of this value. Each tension spring 216*a* has a function of adjusting an effective length of the string 216. Therefore, use of a single elastic rubber band can be an alternative design for the structure shown in the second embodiment, having the string 216 and the tensions spring 216*a*.

Figure 13:
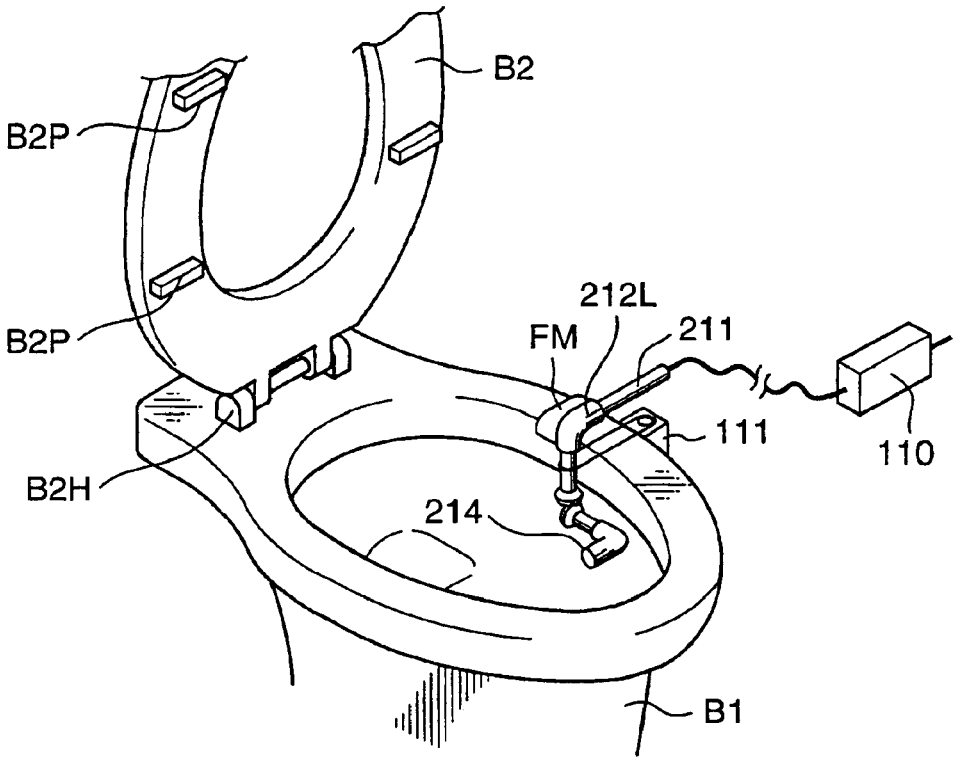
FIG. 13 is a perspective view showing a state where a nozzle posture changing mechanism is mounted onto the toilet-stool main body.

FIG. 13 is a perspective view showing a state where the nozzle posture changing mechanism (NM1) is mounted to the toilet-stool main body B1 and the nozzle 214 is facing obliquely downward for ready to discharge cold water before the use by a toilet user. The motor M is placed in a case 111 and the case 111 can be provided on a lateral side of the toilet-stool main body B1. The first tube 211 needs to be fixed with respect to the toilet-stool main body B1 thus a means FM for fixing the first tube 211 is to be used. In this embodiment, fixing means (FM) fixedly provided to the L-shaped joint 212L is attached to the top edge of the toilet-stool main body B1. Any means that can properly fix the first tube 211 onto the edge of the toilet-stool main body B1 such as a use of epoxy putty or a mechanical fixing member can be used. The position of the motor case 111 and the nozzle posture changing mechanism (NM1) can be adjusted with the use of proper tools. In order to earn a height for mounting the mechanism (NM1) to avoid a collision with the toilet seat B2 from the above (see FIG. 13), a care must be exercised. For that, the placement of space pads B2P having a sufficient height underside of the toilet seat B2 and increasing a height for each hinge B2H is one of the design choices. Another possibility is to place a case body 12 (see FIG. 1) forming a cutout portion C—C, corresponding to the portion where the first pipe 211 extends, is provided between the toilet-stool main body B1 and the toilet seat B2.

Figure 14:
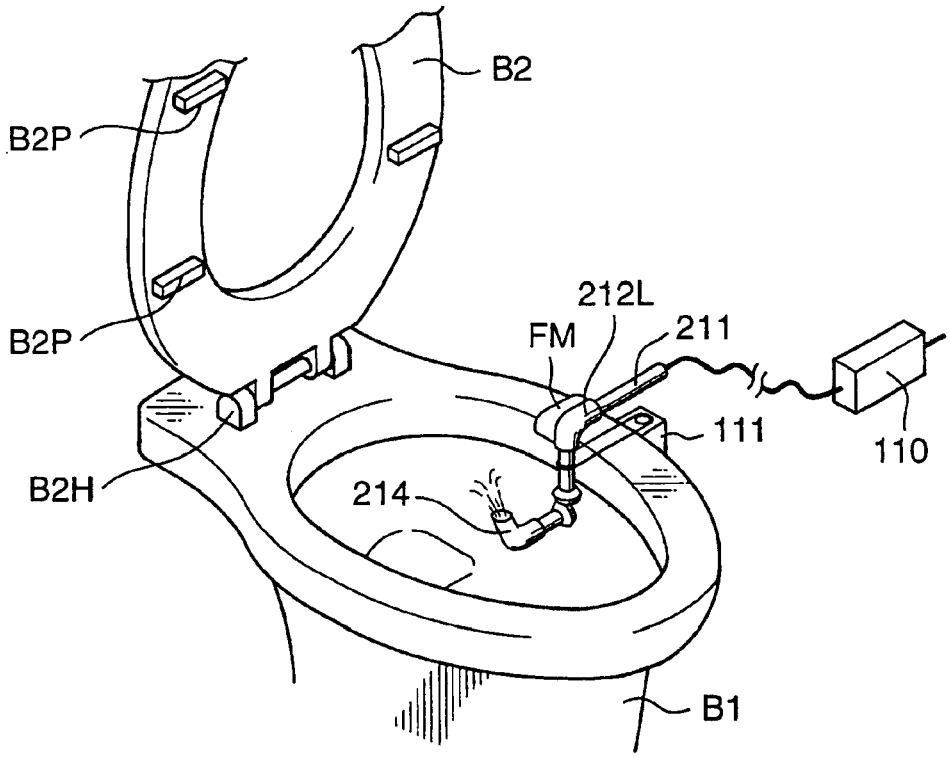
FIG. 14 is a perspective view similar to FIG. 13 except a nozzle being facing obliquely upward for ready to eject warm water.

FIG. 14 is a perspective view similar to FIG. 13, however, showing a state where the nozzle 214 is facing obliquely upward for ready to eject warm water.

Note that the nozzle 214 can be used for cleansing both anal portion of both sexes and a particular portion of female with a cooperation of the user; moving either forward or backward direction.

Figure 15:
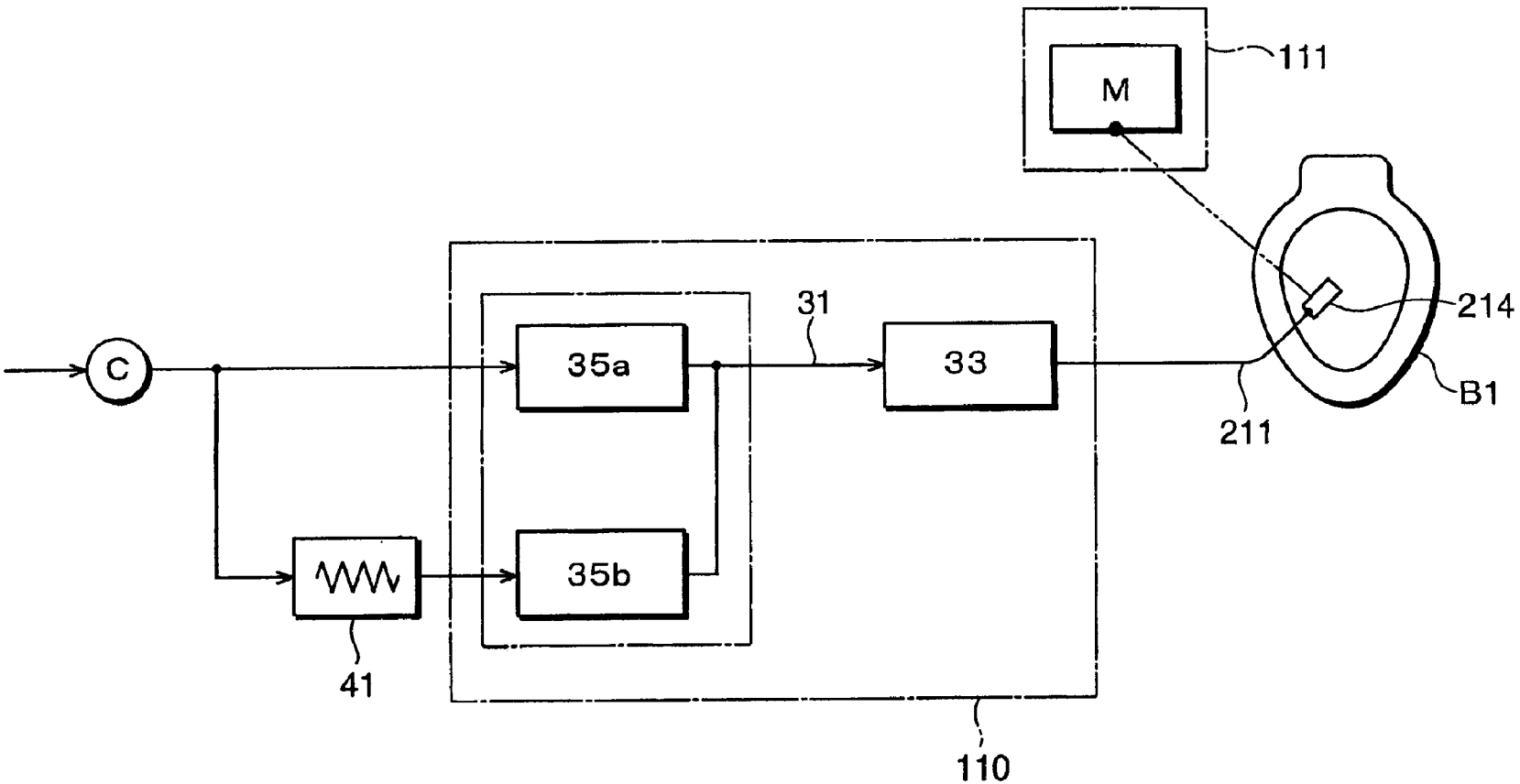
FIG. 15 is a diagram showing a connection of each part for the aforementioned first and the second embodiments with the use of the nozzle posture changing mechanism.
Figure 18:
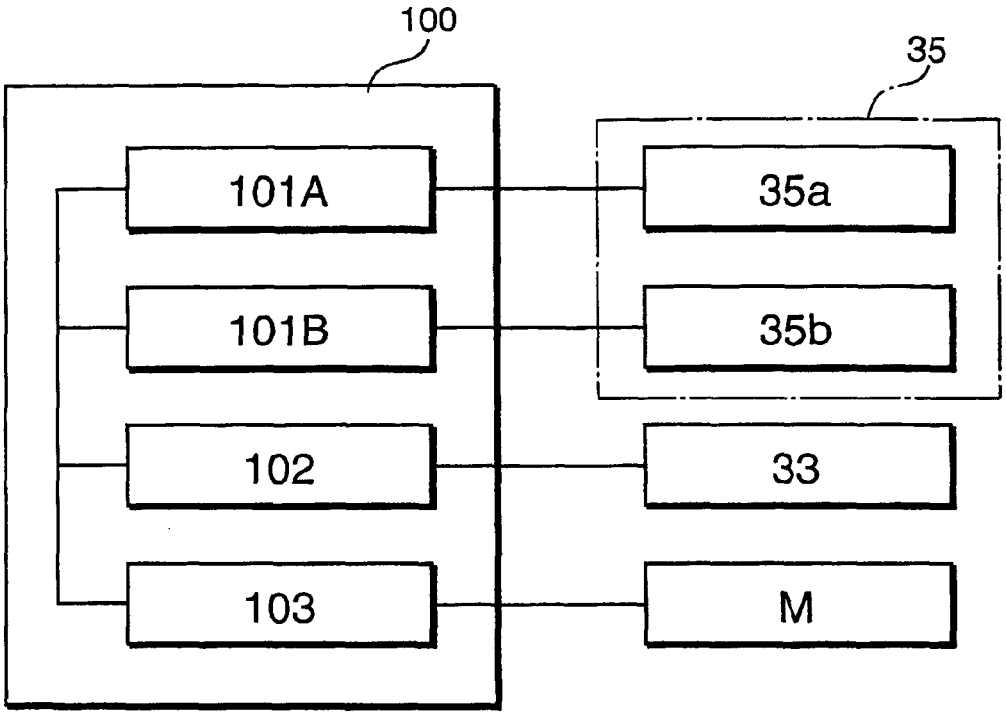
FIG. 18 is a block diagram for a controller having the operation timing controllers which control the timings of operation of the respective valves and the motor.

FIG. 15 is a diagram showing a connection of each part for the aforementioned first and the second embodiments with the use of the nozzle posture changing mechanism (NM1, NM2). As can be easily seen by comparing with FIG. 4, a drain valve 34 and a duct 34*a* are omitted in the diagram of FIG. 15. This is because in these embodiments the cold water discharging function can be performed without reliance on the drain valve 34 and the duct 34*a*. As at the beginning, standby state, the nozzle 214 is set to face obliquely downward so through this nozzle 214 any remaining cold water in the duct passage 31 can be discharged into the inside of the toilet-stool main body B1. Moreover, an open/close valve 33 can be configured as shown in FIG. 18 with a controller 100 having an opening & closing timing controller 103 to open only when the water in the duct passage 31 becomes sufficiently warm.

Figure 16:
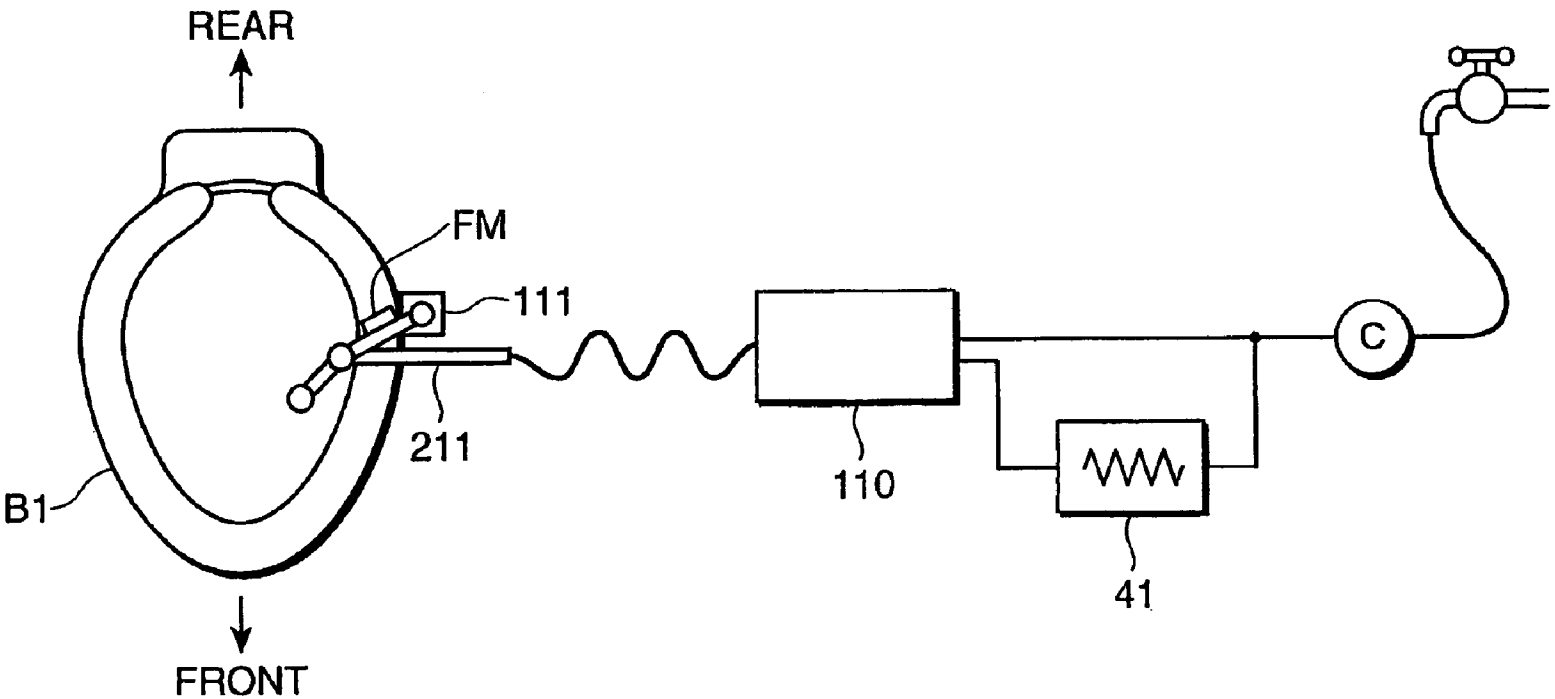
FIG. 16 is a diagram showing an arrangement of the washing unit of the present invention with respect to the toilet-stool main body B1.

FIG. 16 is a schematic diagram showing an arrangement of the washing unit of the present invention with respect to the toilet-stool main body B1. As shown a case 110 containing all the elements 35, 31, 33 disclosed in FIG. 15 can be placed at a convenient place in a toilet. The nozzle posture changing mechanism (NM) can be placed at any convenient place with respect to the toilet-stool main body B1 by the fixing means (FM).

Figure 17A:
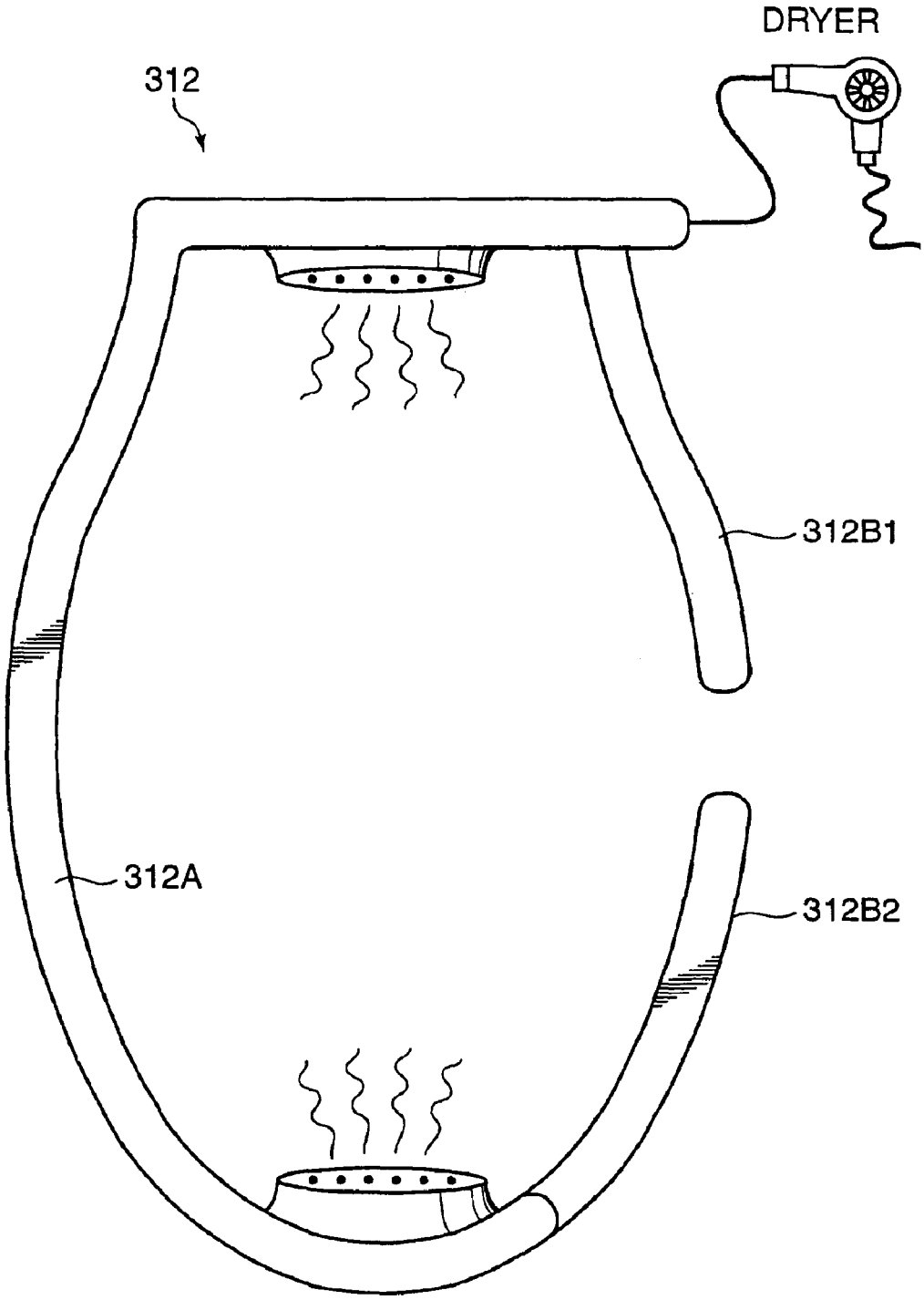
FIG. 17A is a diagram showing a top view of a warm air ejecting unit which consists of an air circulating portion and a non-circulating portion.
Figure 17B:
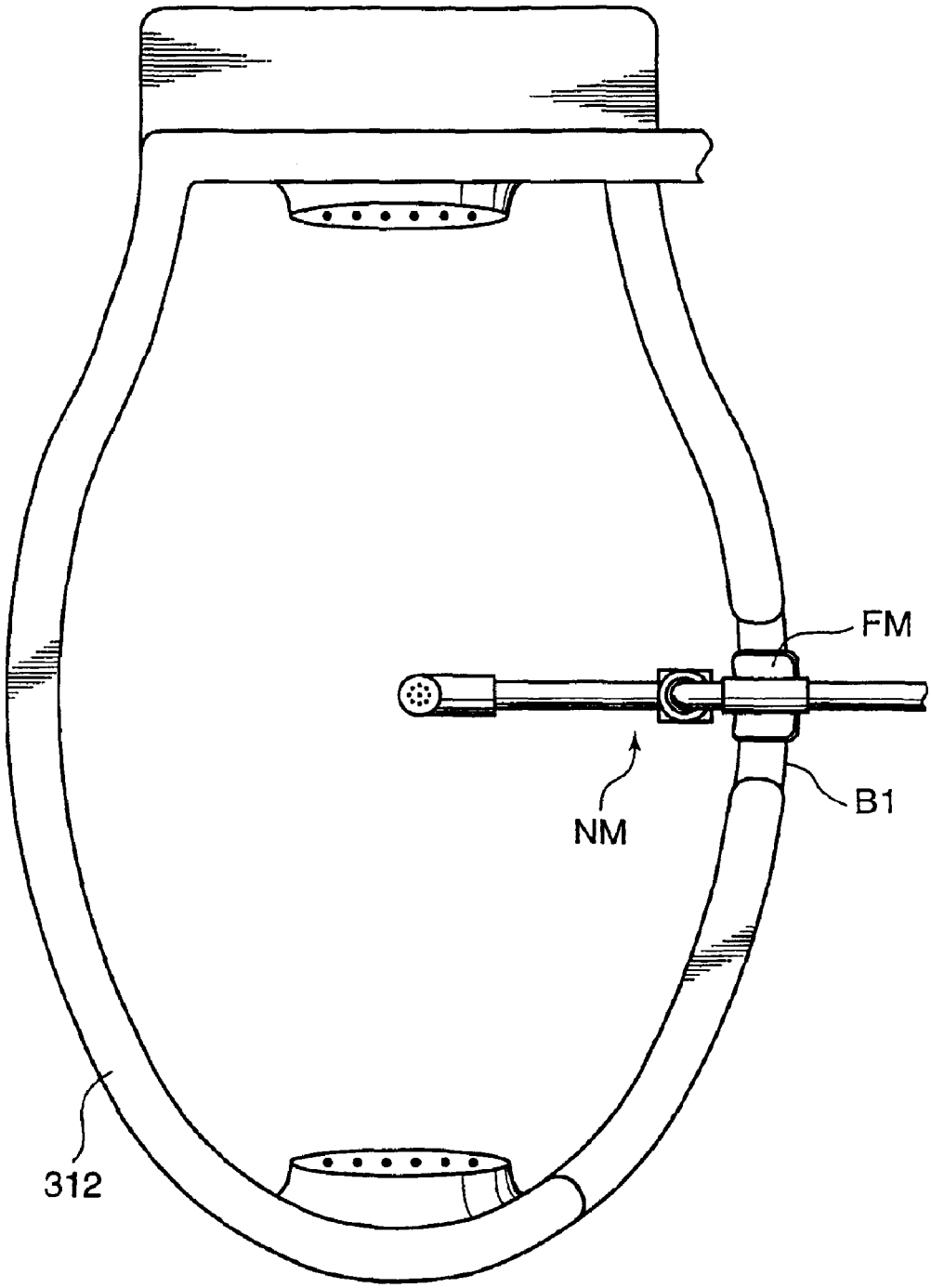
FIG. 17B is a top view showing a state where a warm air ejecting unit and a nozzle posture changing mechanism are both mounted on the edge of the toilet-stool main body B1.

FIG. 17A is a diagram showing a top view of a warm air ejecting unit 312 which consists of an air circulating portion 312A and a non-circulating portion 312B. The non-circulating portion 312B is used as a pad for the toilet seat (B2) placed from the above for maintaining a stability and balance of the toilet seat (B2) when in use by the toilet user. The perspective view of this unit is similar to a case body 12 shown in FIG. 1. Thus the mounting method of this unit is substantially similar to the structure shown in FIG. 1. Note that a cutout portion is provided on the right side (in FIG. 17A) for the purpose of providing a space for mounting the nozzle posture changing mechanism (NM). FIG. 17B is a diagram showing a top view of a state when the warm air ejecting unit 312 and the nozzle posture changing unit (NM) are both mounted to the toilet-stool main body (B1).

Furthermore, the warm air ejecting unit 312 can be made in the form of a tube having only a portion corresponding to the reference numeral 312A as shown in FIG. 17A and is placed around an upper inner surface of the toilet stool main body B1. In this manner, the provision of the non-circulating portion 312B1, B2 for maintaining a balance of the toilet seat B2 can be eliminated. The source of the warm air can be derived from a hair drier (as shown in FIG. 17*a*) or any other warm air supplying means, readily available on the market.

FIG. 18 shows a block diagram for a controller 100 having the operation timing controllers 101A, 101B, 102, & 103, which control the timings of operation of the respective valves 35*a*, 35*b*, 33, and the motor M.

In summary of this CIP application, the invention relates to a body washing unit for a toilet stool, which comprises: a first tube 211 for drawing a warm water from a warm water source; a second tube 212 being rotatably connected with the first tube 211, the second tube 212 being oriented substantially in a vertical direction; a third tube 213 being rotatably connected with the lower end of the second tube 212; a nozzle 214 fixedly provided on the leading end of the third tube 213 for ejecting a warm water to cleanse a certain portion of a body; a drive means for rotating the second tube 212 around its own axis (A2) such that the third tube 213 is angularly displaced around the central axis (A2) of the second tube 212 between a standby position (S.P.) and a usage position (U.P.) via a motion conversion means (MC); said motion conversion means (MC) converting the rotational motion of the second tube 212 around its own axis (A2) into the rotational motion of the third tube 213 around its central axis (A3) such that the nozzle 214 changes its orientation between its downwardly oriented posture (DP) at the standby position (S.P.) and its upwardly oriented posture (UP) at the usage position (U.P.); and a timing controller for controlling a timing of the operation of drive means so that cold water remaining in the first tube 211 is discharged when said nozzle 214 is in said downwardly oriented posture (DP).

With the aforementioned body washing unit, discharging cold water before the use can be done through the nozzle as the nozzle is facing downward at the standby position (S.P.), that can eliminate the provision of the drain valve 34 and the drain duct 34*a*, shown in FIG. 4.

More specifically, said motion conversion means (MC1) may include a fixed member 215*a* having a first gear portion provided around the lower part of the second tube 212 and a driven member 215*b* having a second gear portion in mesh with the first gear portion of the fixed member 215*a*, said fixed member 215*a* is fixedly provided with respect to the first tube 211 so that the second tube 212 is freely rotatable with respect to the fixed member 215*a* and said driven member 215*b* is fixedly provided around the third tube 213 so that when the second tube 212 is rotated around its own axis (A2) and the third tube 213 is swiveled about the center axis (A2), the driven member 215*b* in mesh with the fixed member 215*a* is driven by the first gear portion of the fixed member 215*a* so that the third tube 213 is rotated around its own axis (A3).

With the aforementioned features included into the motion conversion means, the motion conversion between the rotational motion of the second tube 212 about its own axis (A2) and the rotational motion of the third tube 213 about its own axis (A3) and concurrent swivel motion of the third tube 213 around the axis (A2) can be reliably performed.

Another form of the motion conversion means (MC2) can be constructed with an engaging plate 216*c* having engaging portions 216*f*1, 216*f*2 provided around the upper part of the second tube 212 such that the second tube 212 is rotatable with respect to the engaging plate 216*c* and a drive member 216 being in a form of elastic string, having opposite ends fixed onto the engaging portions 216*f*1, 216*f*2 of the engaging plate 216*c* and a middle portion fixed onto a predetermined point 213*p* on the outer circumferential surface of the third tube 213 such that the string is wound around the third tube with said fixed point and when the third tube 213 is being swiveled around the second axis (A2) due to the rotation of the second tube 212 around its own axis (A2), the third tube 213 is being rotated around its own axis (A3).

With the aforementioned features included into the motion conversion means, the motion conversion between the rotational motion of the second tube 212 about its own axis (A2) and the rotational motion of the third tube 213 about its own axis (A3) and concurrent swivel motion of the third tube 213 around the axis (A2) can be reliably performed.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A body washing unit for a toilet stool, comprising:

a first tube for drawing a warm water from a warm water source;

a second tube being rotatably connected with the first tube, the second tube being oriented substantially in a vertical direction;

a third tube being rotatably connected with the lower end of the second tube;

a nozzle fixedly provided on the leading end of the third tube for ejecting a warm water to cleanse a certain portion of a body;

a drive means for rotating the second tube around its own axis (A2) such that the third tube is angularly displaced around the central axis (A2) of the second tube between a standby position (S.P.) and a usage position (U.P.) via a motion conversion means (MC);

said motion conversion means (MC) converting the rotational motion of the second tube around its own axis (A2) into the rotational motion of the third tube around its central axis (A3) such that the nozzle changes its orientation between its downwardly oriented posture (DP) at the standby position (S.P.) and its upwardly oriented posture (UP) at the usage position (U.P.); and a timing controller for controlling a timing of the operation of said nozzle such that cold water remaining in the first tube is discharged before warm water is ejected.

2. The body washing unit according to claim 1, wherein said motion conversion means (MC1) includes a fixed member having a first gear portion provided around the lower part of the second tube and a driven member having a second gear portion in mesh with the first gear portion of the fixed member, said fixed member is fixedly provided with respect to the first tube so that the second tube is freely rotatable with respect to the fixed member and said driven member is fixedly provided around the third tube so that when the second tube is rotated around its own axis (A2) and the third tube is swiveled about the center axis (A2), the driven member in mesh with the fixed member is driven by the first gear portion of the fixed member so that the third tube is rotated around its own axis (A3).

3. The body washing unit according to claim 2, wherein said drive means includes a motor, a driven member fixedly placed around the second tube, and a drive transmission member transmitting a drive power from the motor to the driven member.

4. The body washing unit according to claim 3, wherein said motor is adapted to be provided outside of a toilet stool main body and said first tube extends substantially in a horizontal direction across an upper edge of the toilet stool main body.

5. The body washing unit according to claim 2, wherein said fixed member is of a segment of a ring member provided with a plurality of rack gears facing downward and the driven member is of a segment of pinion gear provided with a plurality of gears in mesh with said rack gears.

6. The body washing unit according to claim 5, further comprising a heater unit for heating water from an outside source and a mixing valve for mixing water from the outside source and hot water supplied from the heater unit and supplying the warm water to the first tube.

7. The body washing unit according to claim 1, wherein said motion conversion means (MC2) includes an engaging plate having engaging portions provided around the upper part of the second tube such that the second tube is rotatable with respect to the engaging plate and a drive member being in a form of elastic string, having opposite ends fixed onto the engaging portions of the engaging plate and a middle portion fixed onto a predetermined point on the outer circumferential surface of the third tube such that the string is wound around the third tube with said fixed point and when the third tube is being swiveled around the second axis (A2) due to the rotation of the second tube around its own axis (A2), the third tube is being rotated around its own axis (A3).

8. The body washing unit according to claim 7, wherein said drive means includes a motor, a driven member fixedly placed around the second tube, and a drive transmission member transmitting a drive power from the motor to the driven member.

9. The body washing unit according to claim 8, wherein said motor is adapted to be provided outside of a toilet stool main body and said first tube extends substantially in a horizontal direction across an upper edge of the toilet stool main body.

10. The body washing unit according to claim 7, wherein said third tube is rotatably connected with the second tube via an L-shaped joint member having one end with an upper opening into which the lower end of the second tube is received and the other end with a horizontal opening into which the end of the third tube is rotatably received.

11. The body washing unit according to claim 7, further comprising a rotational motion restrictor for restricting the rotational motion of the third tube around its own axis (A3), said rotational motion restrictor includes a cutout portion formed in said other end of the L-shaped joint member and an engaging projection provided on the circumferential surface of the third tube at a position within the cutout portion such that the rotational movement of the engaging projection as the third tube around its own axis (A3) is restricted by the engagement of the projection with opposite ends of the cutout portion.

12. The body washing unit according to claim 7, wherein said string form drive member is provided with a spring at vicinity of the opposite ends of the drive member so that the drive member as a whole is elastically deformable as the third tube is swiveled around the central axis (A2) of the second tube.

13. The body washing unit according to claim 7, further comprising a heater unit for heating water from an outside source and a mixing valve for mixing water from the outside source and hot water supplied from the heater unit and supplying warm water to the first tube.

* * * * *